US010765234B1

(12) United States Patent
Awalt

(10) Patent No.: US 10,765,234 B1
(45) Date of Patent: Sep. 8, 2020

(54) SHELF COVER WITH PRICE TAG HOLDER

(71) Applicant: Barry A. Awalt, Waterville, ME (US)

(72) Inventor: Barry A. Awalt, Waterville, ME (US)

( * ) Notice: Subject to any disclaimer, the term of this patent is extended or adjusted under 35 U.S.C. 154(b) by 0 days.

(21) Appl. No.: 16/520,101

(22) Filed: Jul. 23, 2019

(51) Int. Cl.

| | |
|---|---|
| ***A47F 5/00*** | (2006.01) |
| ***G09F 3/20*** | (2006.01) |
| ***A47B 96/02*** | (2006.01) |
| ***A47F 5/08*** | (2006.01) |

(52) U.S. Cl.
CPC ..... *A47F 5/0068* (2013.01); *A47B 96/021* (2013.01); *A47F 5/0043* (2013.01); *A47F 5/0869* (2013.01); *G09F 3/204* (2013.01); *A47B 2220/0038* (2013.01)

(58) Field of Classification Search
CPC . G09F 3/204; G09F 3/202; G09F 3/20; G09F 7/08; G09F 7/10; A47F 5/0068; A47F 5/0018; A47F 5/0043; A47F 5/0062; A47F 5/0838; A47F 5/0846; A47F 5/0853; A47F 5/0869; A47F 5/16; A47B 55/00; A47B 96/02; A47B 96/027; A47B 96/068; A47B 96/18; A47B 96/201; A47B 96/021; A47B 97/00; A47B 13/08; A47B 13/083; A47B 13/086; A47B 2220/0038; A47B 47/04; A47B 96/043; A47B 2095/046; A47B 17/022; A47B 45/00; Y10T 24/45105
USPC ..... 211/183, 119.003, 90.01, 135, 72, 73, 211/153; 108/27, 90, 42
See application file for complete search history.

(56) References Cited

U.S. PATENT DOCUMENTS

| | | | | | |
|---|---|---|---|---|---|
| 3,241,334 | A * | 3/1966 | Amore | F25D 25/021 | 62/382 |
| 3,637,085 | A * | 1/1972 | Ball | A47B 96/021 | 211/153 |
| 3,647,078 | A * | 3/1972 | Fortunato | A47F 5/0068 | 211/134 |
| 3,998,069 | A * | 12/1976 | Kronenberger | F25D 17/045 | 62/288 |
| 4,564,548 | A * | 1/1986 | Fast | A47B 96/02 | 428/121 |
| 4,606,280 | A * | 8/1986 | Poulton | A47F 5/0068 | 108/152 |
| 4,698,928 | A * | 10/1987 | Soporowski | G09F 7/08 | 40/605 |
| 5,044,104 | A * | 9/1991 | Hopperdietzel | G09F 3/20 | 40/649 |
| 5,228,581 | A * | 7/1993 | Palladino | A47F 3/0486 | 108/90 |
| 5,415,302 | A * | 5/1995 | Carlson | A47B 55/02 | 108/147.13 |
| 5,538,147 | A * | 7/1996 | Fucci | A47B 96/021 | 108/90 |
| 5,697,302 | A * | 12/1997 | Putnam | A47B 55/02 | 108/90 |
| 6,126,125 | A * | 10/2000 | Dalton | G09F 3/204 | 248/205.2 |
| 6,226,910 | B1 * | 5/2001 | Ireland | G09F 3/204 | 40/651 |
| 6,401,945 | B1 * | 6/2002 | Gawel | A47B 96/021 | 108/90 |

(Continued)

*Primary Examiner* — Jennifer E. Novosad
(74) *Attorney, Agent, or Firm* — Anthony D. Pellegrini

(57) ABSTRACT

A shelf cover configured to be placed onto a shelf of a shelving unit, retained in place by one or more rear retention flanges, and having an integrated removable price tag holder located on its front edge.

7 Claims, 11 Drawing Sheets

(56) References Cited

U.S. PATENT DOCUMENTS 6,553,702 B1 * 4/2003 Bacnik ..... G09F 3/204 40/649
6,571,498 B1 * 6/2003 Cyrluk ..... G09F 3/204 108/27
6,725,785 B2 * 4/2004 Wang ..... A47B 13/08 108/90
7,063,217 B2 * 6/2006 Burke ..... A47F 1/126 211/119.003
7,810,440 B2 * 10/2010 Ward ..... A47B 96/021 108/161
7,882,969 B2 * 2/2011 Gerstner ..... A47F 3/14 211/119.003
8,069,994 B2 * 12/2011 Barkdoll ..... A47F 1/126 211/119.003
8,172,096 B2 * 5/2012 Van De Steen ..... A47B 96/02 211/119.003
8,511,488 B2 * 8/2013 Poisson ..... A47B 96/021 211/153
8,871,324 B2 * 10/2014 Hansel ..... A47B 97/00 108/90
8,925,745 B2 * 1/2015 Theisen ..... F21V 33/00 211/10
9,149,119 B2 * 10/2015 Hansel ..... A47F 5/0043
9,585,475 B2 * 3/2017 Tines ..... A47B 55/02
2002/0170870 A1 * 11/2002 Callis ..... A47B 96/02 211/119.003
2004/0004052 A1 * 1/2004 Young ..... A47F 5/01 211/183
2004/0060883 A1 * 4/2004 Walker ..... A47F 5/005 211/119.003
2004/0200793 A1 * 10/2004 Hardy ..... A47F 5/0068 211/119.003
2004/0237369 A1 * 12/2004 Andersson ..... G09F 3/204 40/661.03
2005/0139560 A1 * 6/2005 Whiteside ..... A47B 57/586 211/119.003
2006/0054063 A1 * 3/2006 Ryan, Jr. ..... A47B 47/0083 108/27
2006/0180056 A1 * 8/2006 Dorholt ..... A47B 13/086 108/90
2007/0023374 A1 * 2/2007 Nawrocki ..... A47F 5/0846 211/90.01
2007/0044361 A1 * 3/2007 Gormley ..... G09F 3/204 40/661.03
2007/0251426 A1 * 11/2007 Li ..... A47B 55/02 108/27
2008/0017600 A1 * 1/2008 Thompson ..... A47B 96/021 211/119.003
2009/0001037 A1 * 1/2009 Wilcock ..... A47B 97/00 211/119.003
2017/0020286 A1 * 1/2017 Pierson ..... A47B 96/021

* cited by examiner

SHELF COVER WITH PRICE TAG HOLDER

BACKGROUND OF THE INVENTION

Display shelving for retail sales is well known in the art. Such shelving is typically placed in aisles, with multiple tiers of shelving. A typical style of such shelving is known as gondola shelving. Gondola shelving may be single-sided, with horizontal shelves extending outward from a vertical backing into an aisle. Gondola shelving may also be double-sided, with horizontal shelves extending outward from either side of the vertical backing into adjacent aisles. Shelving also may wrap around the ends, forming end caps.

Most shelving also makes use of price tags to identify the product placed thereon as well as the price and unit cost. Price tags are typically affixed to the front of shelving, in a substantially vertical orientation. Such placement results in difficulty in reading price tags that are affixed to shelves that are significantly below or above eye level.

For purposes of durability, retail shelving is typically made of metal. The shelving is typically painted in a monochrome color.

Retail establishments, such as supermarkets, traditionally perform center store remodels based on the aesthetics or appearance of their metal gondola shelving, not strictly because of functionality. That is, shelving slated for remodeling typically can still support and display product; the appearance, though, is deemed unacceptable. This is because, during use, shelving can over time become dirty, scratched, and dented. Colors may fade, or the finish may become chipped. While dirt can be cleaned, cleaning shelves in place is inconvenient, while bringing shelves to a proper cleaning facility requires disassembly of the entire shelving unit, as would refurbishment. Ad hoc changes to the aesthetics of the shelving, for example, to display holiday colors, is difficult, if not impossible. Replacing tired looking shelving units can be quite costly.

It is thus shown that there is a need for an improved shelving system that enables shelving units to retain high quality aesthetics and to allow for quick and easy maintenance and refurbishment. It is also shown that there is a need for better display of price tags on shelving.

SUMMARY OF THE INVENTION

The present invention discloses a shelf cover which is placed onto each shelf of a shelving unit. No fasteners or adhesives are required. The shelf cover is made of a substantially rigid, durable ABS plastic and can have any color or design desired. The shelf cover can be easily removed for cleaning or replacement, or to change aesthetics seasonally, and easily replaced onto the shelving unit. Integrated with the shelf cover is a removable price tag holder.

The present invention provides substantial advantages over the traditional means for refurbishing shelving. Because the shelving does not need to be replaced, the costs of transporting away entire old shelving systems and transporting in entire new shelving systems is avoided. The disposal of entire old shelving systems is avoided, reducing costs as well as environmental harm. The labor involved in completely disassembling old shelving systems and reassembling new shelving systems is eliminated. The time it would take to remodel an entire retail establishment is drastically shortened. Most importantly, the cost to remodel shelving is greatly reduced.

The present invention provides substantial advantages over the traditional means in regards to maintenance, as well. The shelving covers can be easily removed and brought to a facility for thorough cleaning. This improves the cleanliness of the shelving system over the traditional method of simply wiping down shelving surfaces. The price tag holder can also be removed and brought to a cleaning facility and power washed to remove adhesives. This is an improvement over scraping old price tags off of shelving.

Other features and advantages of the invention are described below.

DETAILED DESCRIPTION OF INVENTION

Figure 10A:
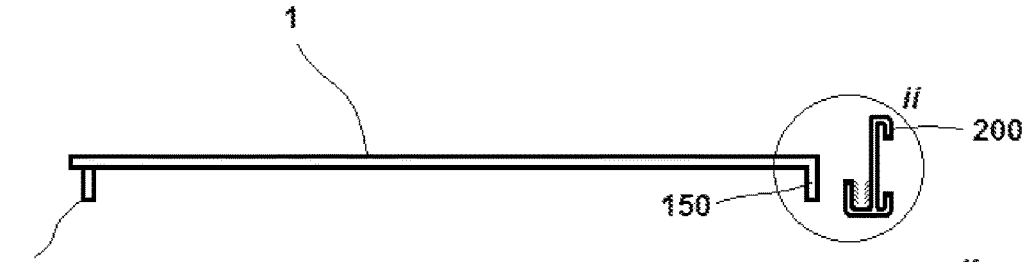
FIG. 10A is a side plan view of the embodiment of the present invention shown in FIG. 9A depicting the price tag support member detached from the front edge of the product support member.
Figure 10B:
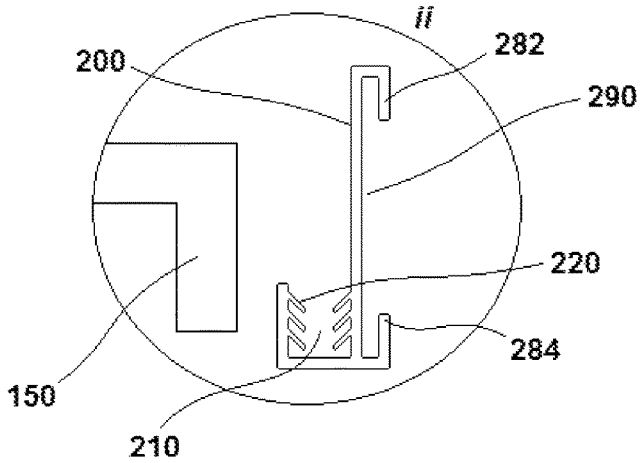
FIG. 10B is an enlarged side plan view of area ii of the embodiment of the present invention shown in FIG. 10A.
Figure 11A:
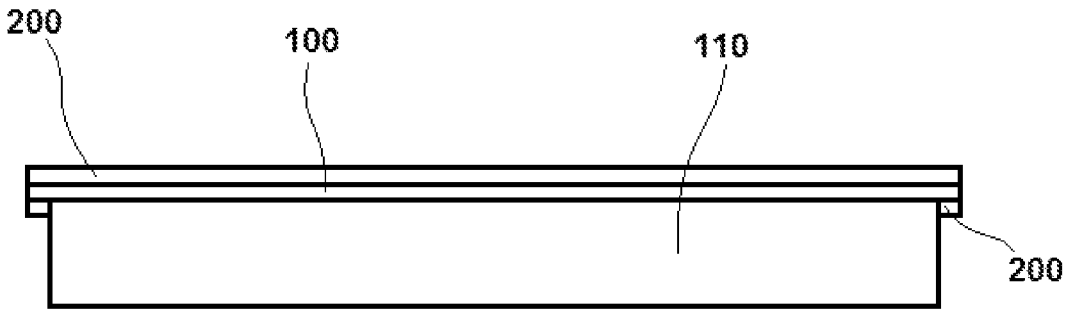
FIG. 11A is a rear plan view of one embodiment of the present invention.
Figure 11B:
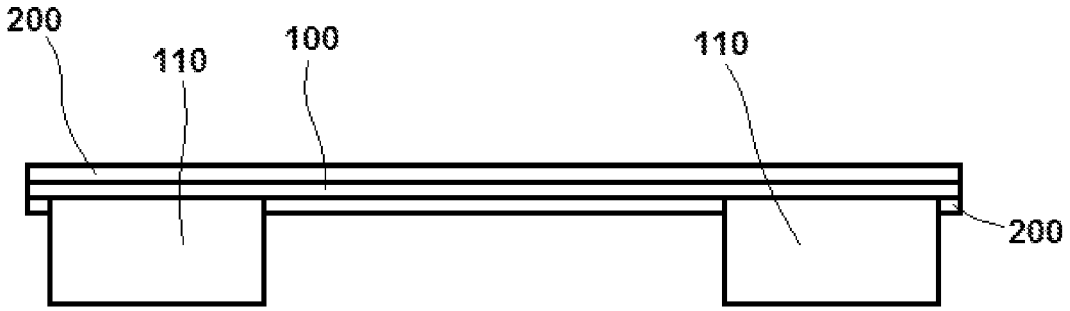
FIG. 11B is a rear plan view of an alternative embodiment of the present invention, wherein there is a plurality of the rear retention flanges.
Figure 12:
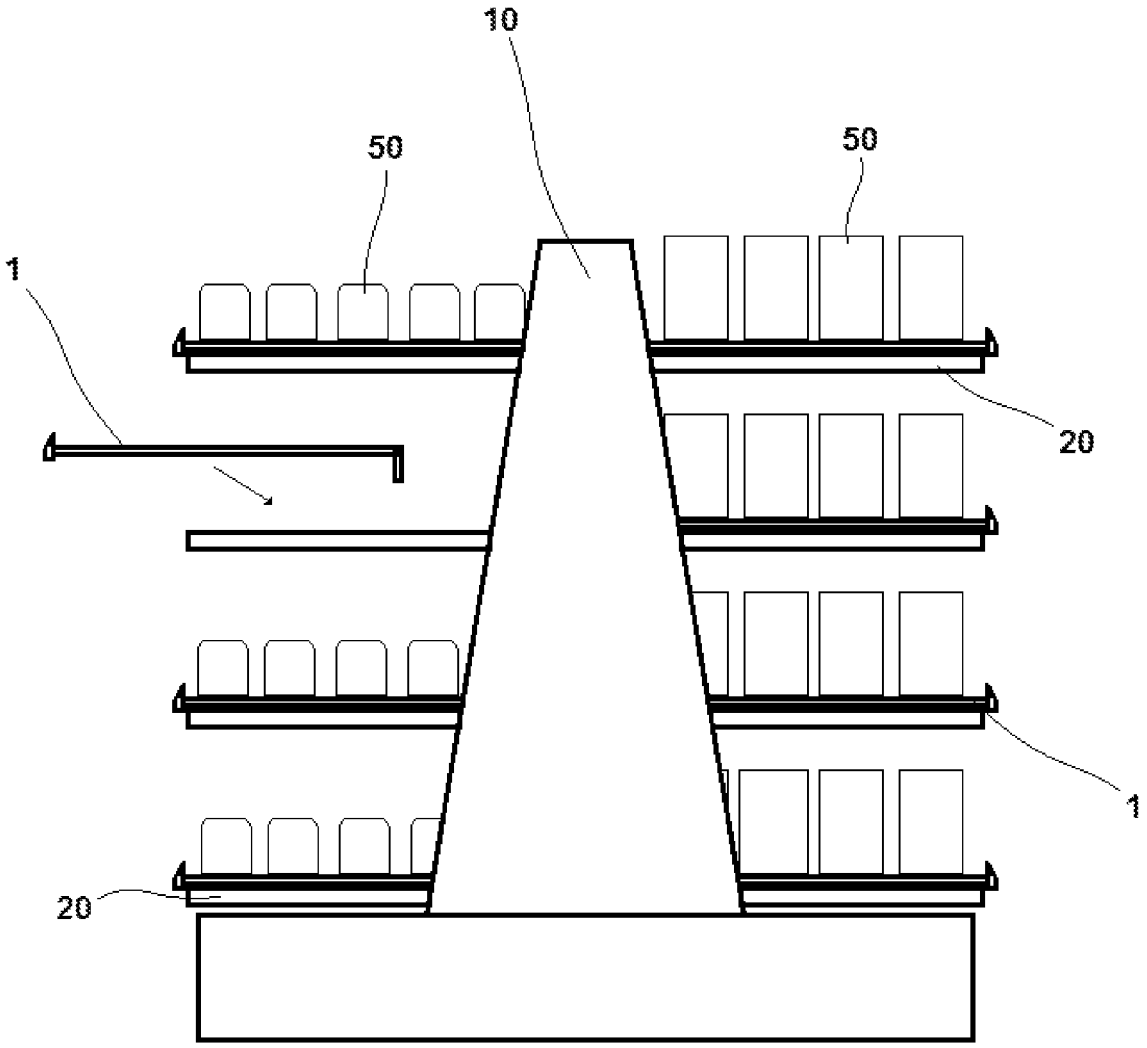
FIG. 12 is a side plan view of a gondola shelving unit with the shelf covers of the present invention placed onto the shelves of the shelving unit.

In one embodiment of the present invention, a shelf cover 1 is disclosed. The shelf cover 1 is intended for use on a shelving unit 10, such as gondola shelving. The shelving unit 10 must have at least one shelf 20 having a depth and oriented substantially horizontally, and a backing element 30 oriented substantially vertically. The shelf 20 of the shelving unit 10 is attached to the backing element 30 of the shelving unit 10 at approximately a ninety degree angle. There is a small gap 22 between the rear edge 24 of the shelf 20 and the backing element 30. Dividers 40 may be present between horizontally adjacent shelves 10. The shelving unit 10 may have shelves 20 located on both sides of the backing element 30. There may also be multiple tiers of shelves 10. See FIG. 12. The shelf cover 1 of the present invention is configured to be placed onto a shelf 20 of the shelving unit 10. See FIGS. 10 and 11.

Figure 1A:
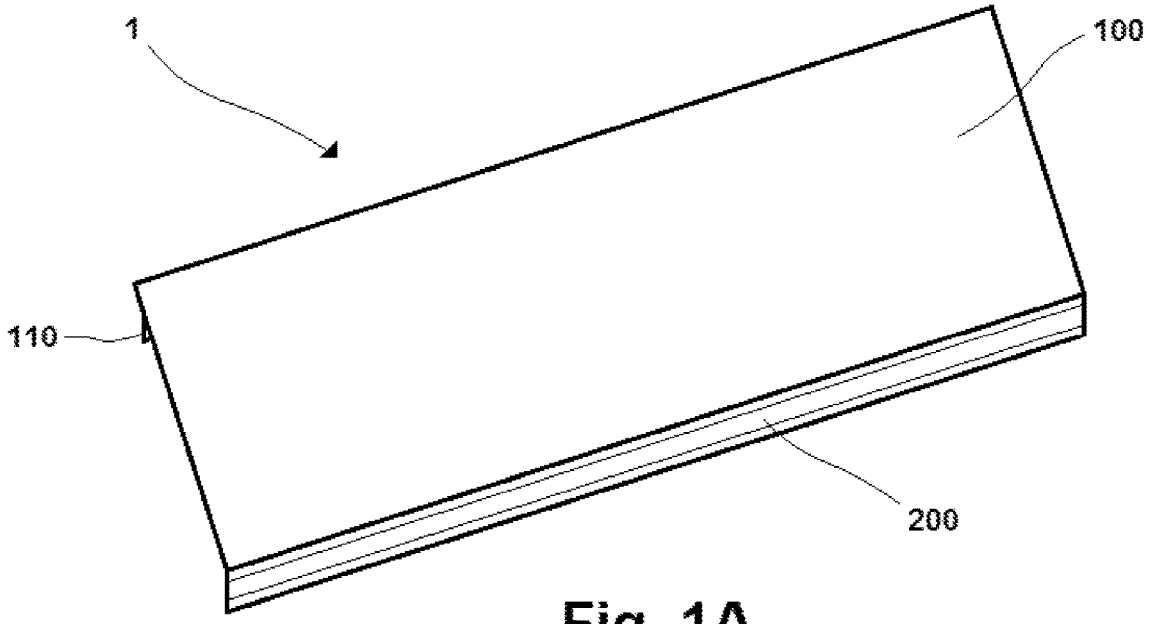
FIG. 1A is a top perspective view of one embodiment of the present invention, depicting the product support member with integrated price tag support member.
Figure 1B:
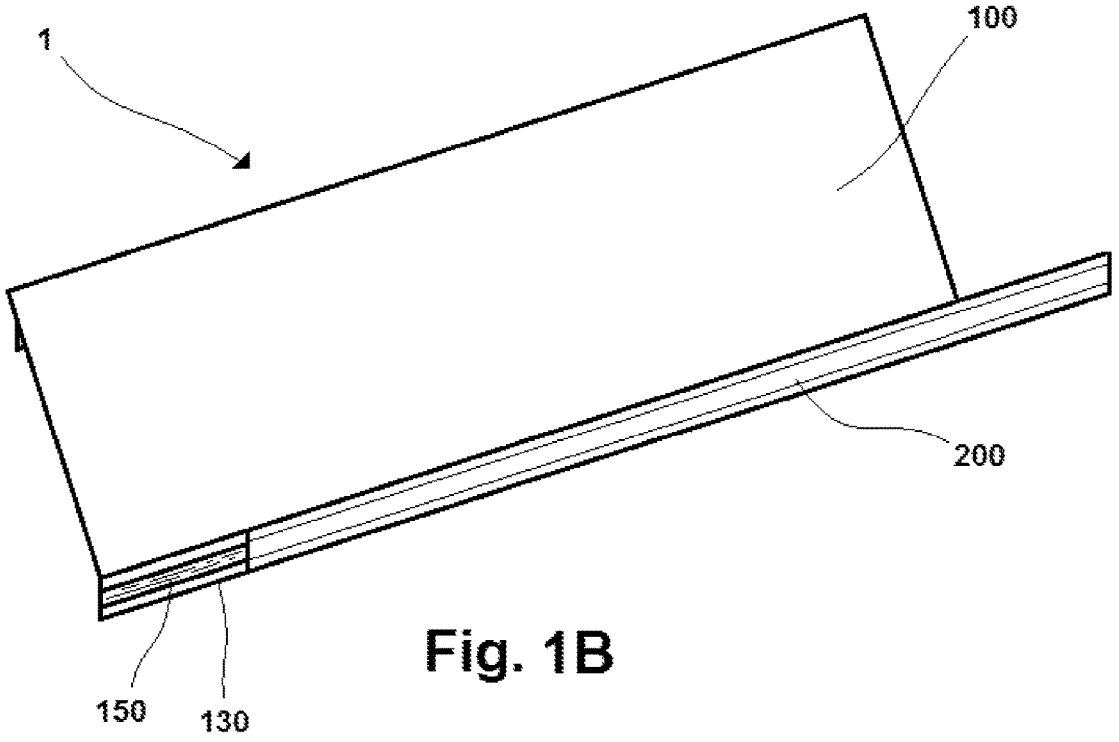
FIG. 1B is a top perspective view of the embodiment of the present invention shown in FIG. 1A, depicting the price tag support member partially removed from the product support member.

In one embodiment, the shelf cover 1 comprise a product support member 100 having an integrated a price tag support member 200. The product support member 100 is substantially planar and rigid, though some minor flexing might occur. Its thickness is relatively small in relation to its width and depth. Its depth is just slightly greater than the depth of the shelf 20 of the shelving unit 10. See FIGS. 1A and 1B. The product support member 100 may be made of any suitable material; preferably, it is made from Acrylonitrile Butadiene Styrene (ABS) plastic. While the product support member 100 may have any suitable thickness, in the preferred embodiment it has a thickness of between $1/32^{nd}$ inch and $1/4^{th}$ inch, with the most preferred thickness being $1/16^{th}$ inch.

Figure 4A:
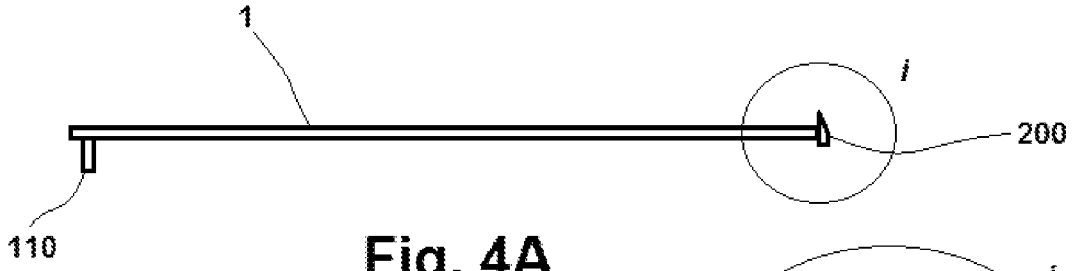
FIG. 4A is a side plan view of the embodiment of the present invention shown in FIG. 1A depicting the price tag support member attached to the front edge of the product support member.
Figure 4B:
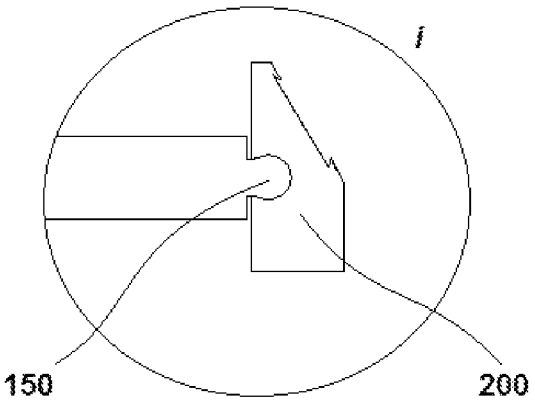
FIG. 4B is an enlarged side plan view of area i of the embodiment of the present invention shown in FIG. 4A.
Figure 5A:
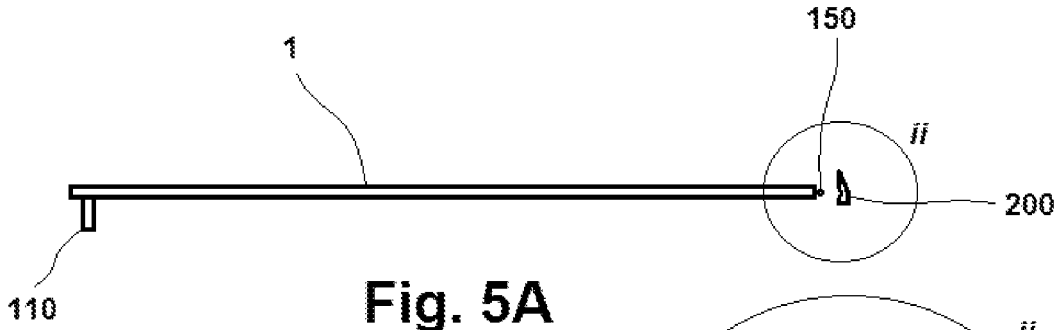
FIG. 5A is a side plan view of the embodiment of the present invention shown in FIG. 4A depicting the price tag support member detached from the front edge of the product support member.
Figure 5B:
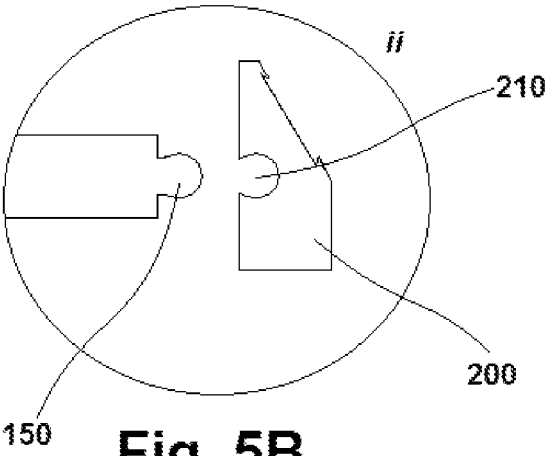
FIG. 5B is an enlarged side plan view of area ii of the embodiment of the present invention shown in FIG. 5A.
Figure 6A:
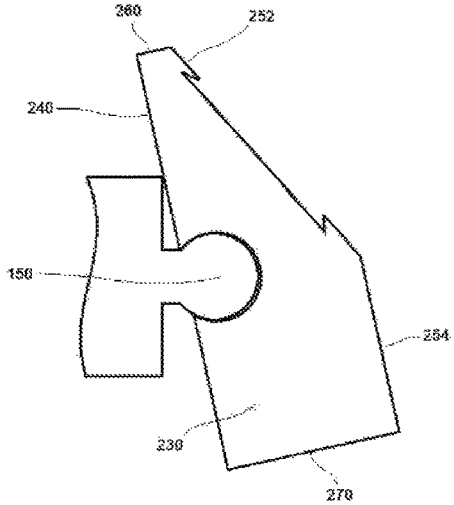
FIG. 6A is a side plan view of the embodiment of the present invention shown in FIG. 4A, wherein the price tag support member is pivoted slightly upward to provide a better view of the price tags when the shelf cover is placed on a shelf below eye level.
Figure 6B:
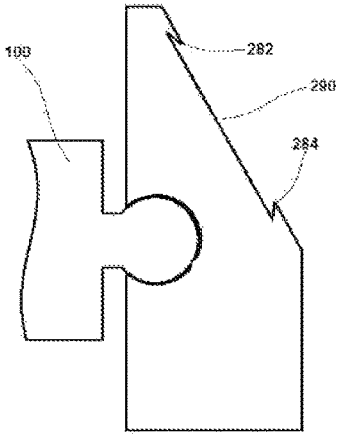
FIG. 6B is a side plan view of the embodiment of the present invention shown in FIG. 4A, wherein the price tag support member is pivoted perpendicular to the product support member to provide a better view of the price tags when the shelf cover is placed on a shelf at eye level.
Figure 6C:
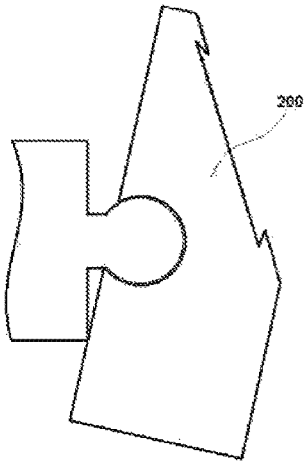
FIG. 6C is a side plan view of the embodiment of the present invention shown in FIG. 4A, wherein the price tag support member is pivoted slightly downward, to provide a better view of the price tags when the shelf cover is placed on a shelf above eye level.
Figure 7:
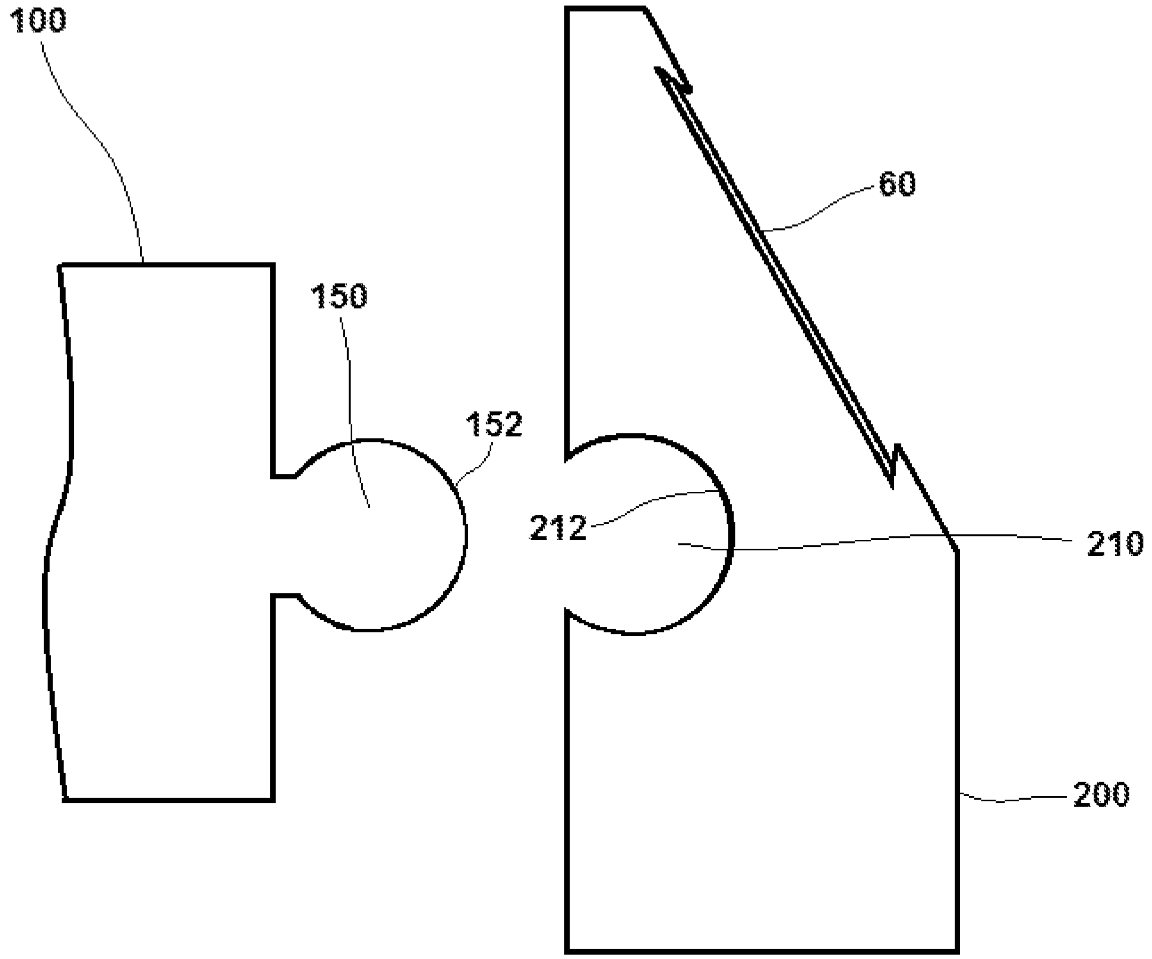
FIG. 7 is a side plan view of the embodiment of the present invention shown in FIG. 4A, wherein the attachment flange of the product support member has a rounded section and the channel of the price tag support member has a rounded cross section.
Figure 8:
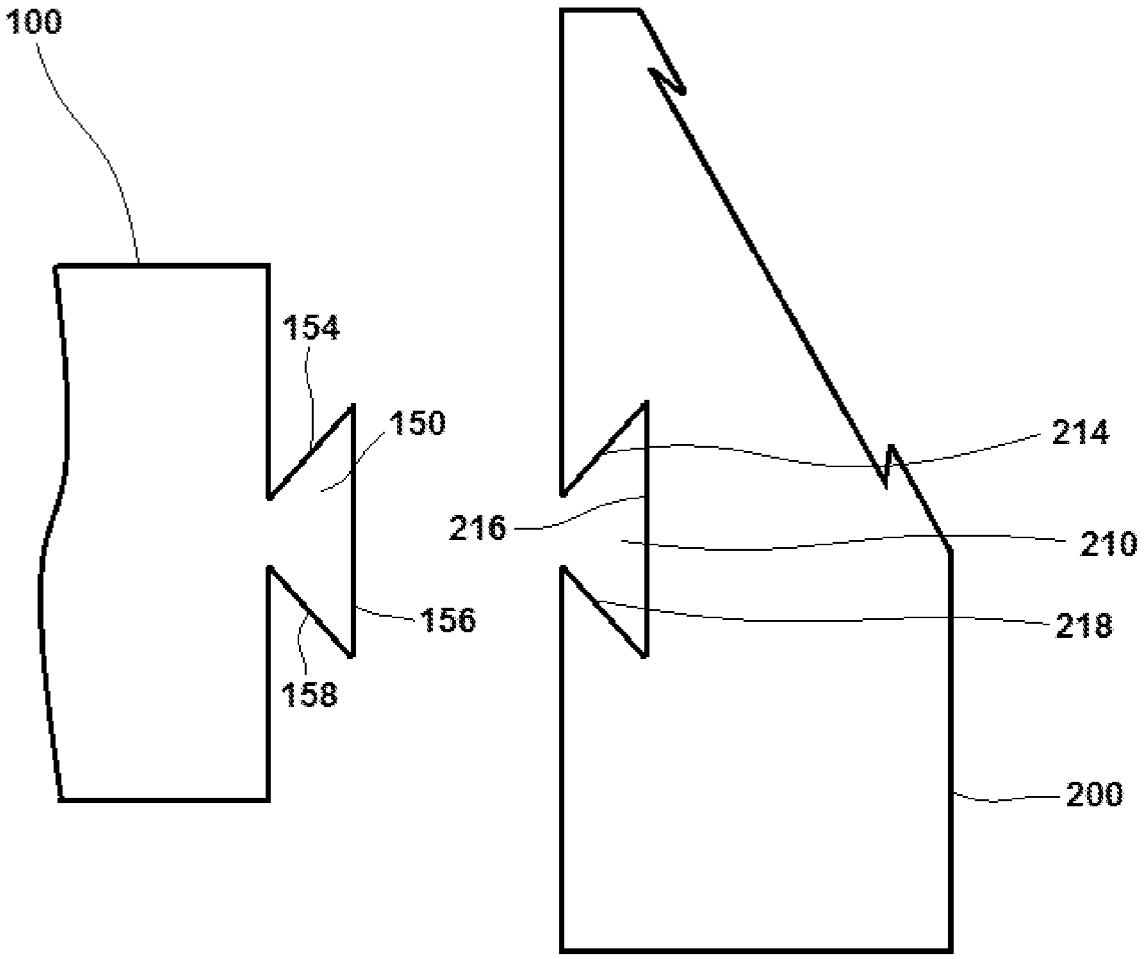
FIG. 8 is a side plan view of an alternative embodiment of the present invention, wherein the attachment flange of the product support member has a triangular cross section and the channel of the price tag support member has a triangular cross section.
Figure 13:
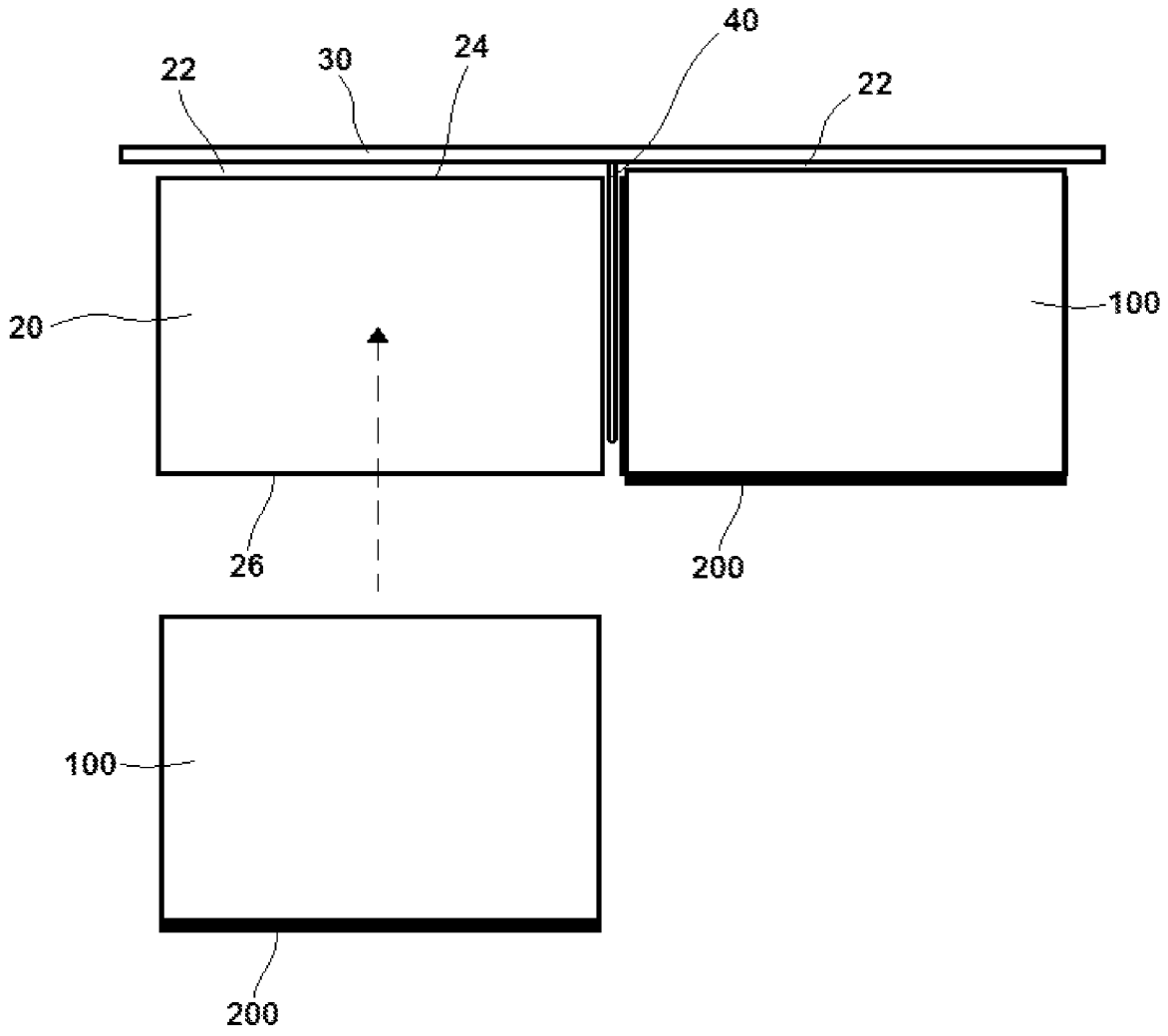
FIG. 13 is a top plan view of two shelves of a gondola shelving unit, depicting the placement of one shelf cover of the present invention onto one shelf of the shelving unit and a second shelf cover already in place on a second shelf.

Integrated with the product support member 100 is a rear retention flange 110. The rear retention flange 110 is located adjacent to the back edge 120 of the product support member 100 and is angled substantially ninety degrees from the product support member 100 in a downward direction. See FIGS. 4A and 5A. The rear retention flange 110 has a uniform thickness which is slightly less than the width of the gap 22 located between the rear edge 24 of the shelf 20 and the backing element 30 of the shelving unit 10. Preferably, the rear retention flange is rectangular in shape. See FIG. 11A. The width of the rear retention flange 110 is slightly less than the width of the product support member 100. This is to accommodate the thickness of the dividers 40 that separate the horizontally adjacent shelves 20. See FIG. 13. In one embodiment, there is a plurality of rear retention flanges 110. See FIG. 11B. In this embodiment, each rear retention flange 110 is located adjacent to the back edge 120 of the product support member 100 and angled substantially ninety degrees from the product support member 100 in a downward direction. Each rear retention flange 110 has a uniform thickness slightly less than the width of the gap 22 between the rear edge 24 of the shelf 20 and the backing element 30 of the shelving unit 10. The combined widths of the rear retention flanges 110 is less than the width of the shelf cover 1. Each of the plurality of rear retention flanges 110 may be substantially rectangular. Other shapes are also contemplated. Preferably, each of the plurality of rear retention flanges 110 is sized substantially the same as each other of the of rear retention flanges 110.

The shelf cover 1 is placed onto a shelf 20 of the shelving unit 10 such that the product support member 100 of the shelf cover 1 rests on the top surface of the shelf 20, and the rear retention flange 110 of the shelf cover 1 is inserted into the gap 22 between the rear edge 24 of the shelf 20 and the backing element 30 of the shelving unit 10. See FIG. 13. The retention flange 110 prevents the shelf cover 1 from sliding forward or from moving laterally. Product 50 placed onto the shelf cover 1 also helps secure the shelf cover 1 to the shelf 20 merely by its weight.

The price tag support member 200 of the shelf cover 1 is located along the front edge 130 of the product support member 100. It is capable of supporting a price tag 60 thereon. The price tag support member 200 extends beyond the front edge 26 of the shelf 20 of the shelving unit 10. See FIGS. 10 and 11.

Figure 3A:
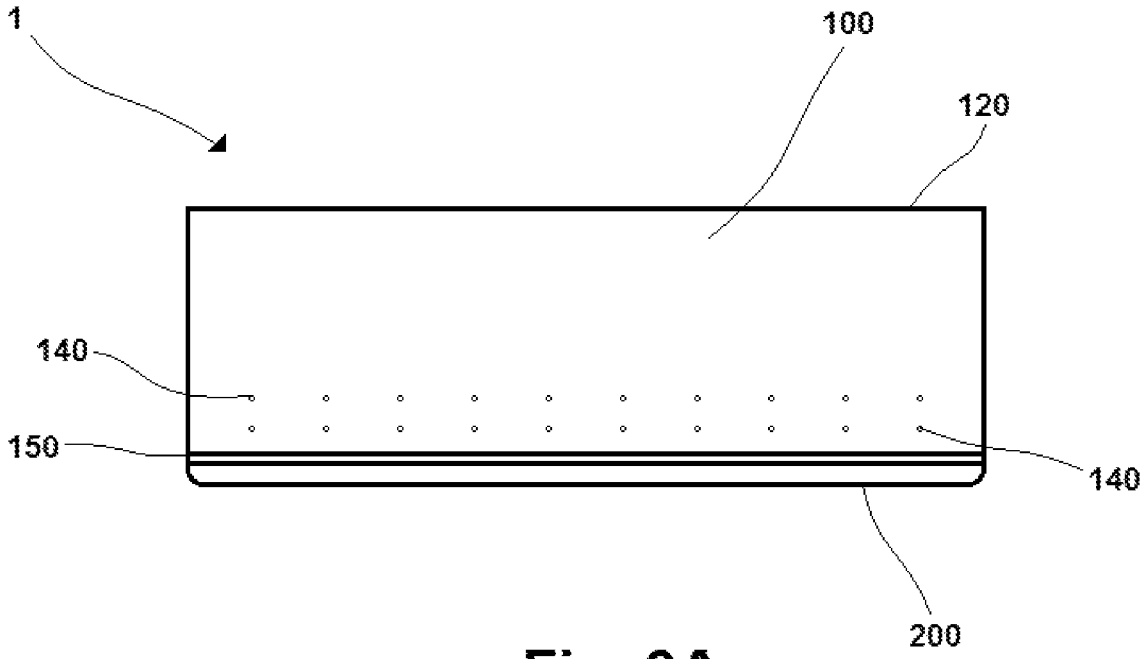
FIG. 3A is a top plan view of the embodiment of the present invention shown in FIG. 1A.
Figure 3B:
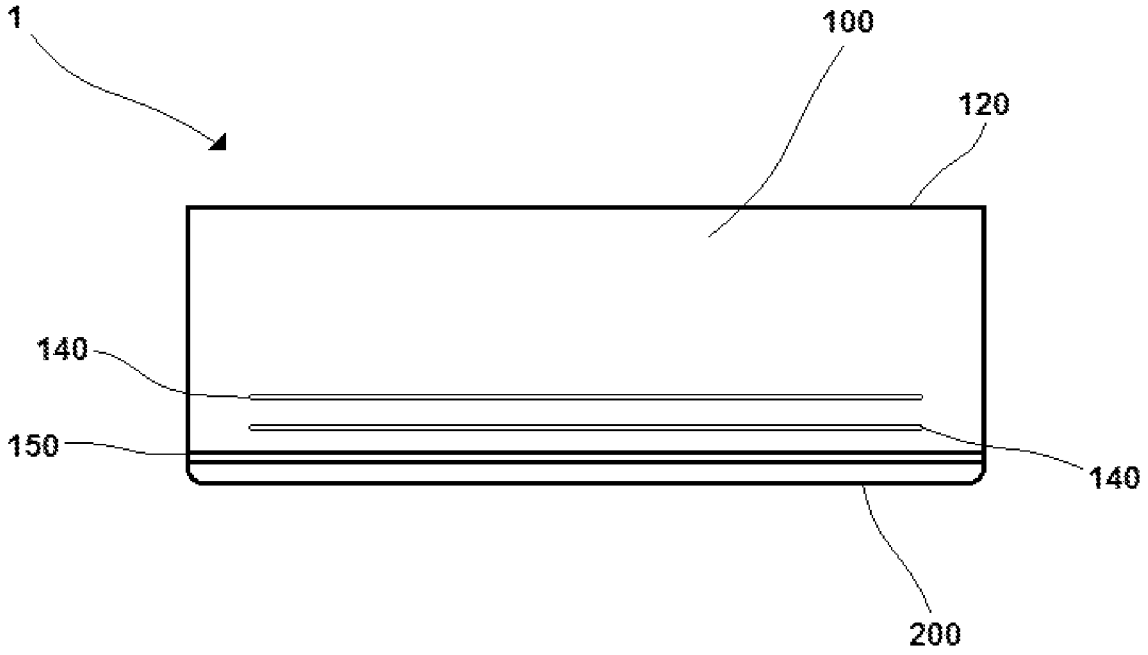
FIG. 3B is a top plan view of an alternative embodiment of the present invention shown in FIG. 1A.

The shelf cover 1 of the present invention may be configured in any number of ways. In the preferred embodiment, the product support member 100 of the shelf cover 1 is substantially rectangular. Other suitable shapes are also contemplated. In another embodiment, the product support member 100 of the shelf cover 1 may comprise a plurality of apertures 140. See FIGS. 3A and 3B. Each of the apertures 140 passes all the way through the thickness of the product support member 100. These apertures 140 allow components of the shelving unit 10, such as dividers, "pushers", tags, and the like, to be attached to a shelf 20 that is covered by the shelf cover 1 through the apertures 140 formed into the shelf cover 1. In one variant each aperture 140 is substantially circular, and a double row of multiple apertures 140 is located proximate to the front edge 130 of the product support member 100. See FIG. 3A. In another variant, there are just two apertures 140, with each aperture 140 being elongate and spanning nearly the entire width of the product support member 100, oriented substantially parallel to each other and located proximate to the front edge 130 of the product support member 100. See FIG. 3B. Other configurations of the apertures 140 are also contemplated. In yet another embodiment, the product support member 100 of the shelf cover 1 is monochrome; alternatively, it may be multi-colored. It may have one or more graphic designs placed on its surfaces, or text, or a combination of both. Such variations allow for different shelf covers 1 to be used during different seasons and holidays, if desired.

In one embodiment, the product support member 100, the rear retention flange 110, and the price tag support member 200 are comprised of a monolithic unit. As such, the shelf cover 1 can be thermos-formed or extruded or otherwise created in one piece with a minimum of labor required. In the preferred embodiment, though, the price tag support member 200 is removably attached to the front edge 130 of the product support member 100. In this embodiment, the product support member 100 comprises an attachment flange 150 located along its front edge 130, and the price tag support member 200 comprises a channel 210 which accommodates the attachment flange 150 of the product support member 100. See FIGS. 4B, 5B, 6A, 6B, 6C, 7, 8, 9B, and 10B. So configured, the price tag support member 200 is attached to the product support member 100 by inserting the attachment flange 150 of the product support member 100 into the channel 210 of the price tag support member 200. See FIG. 1B.

Figure 2:
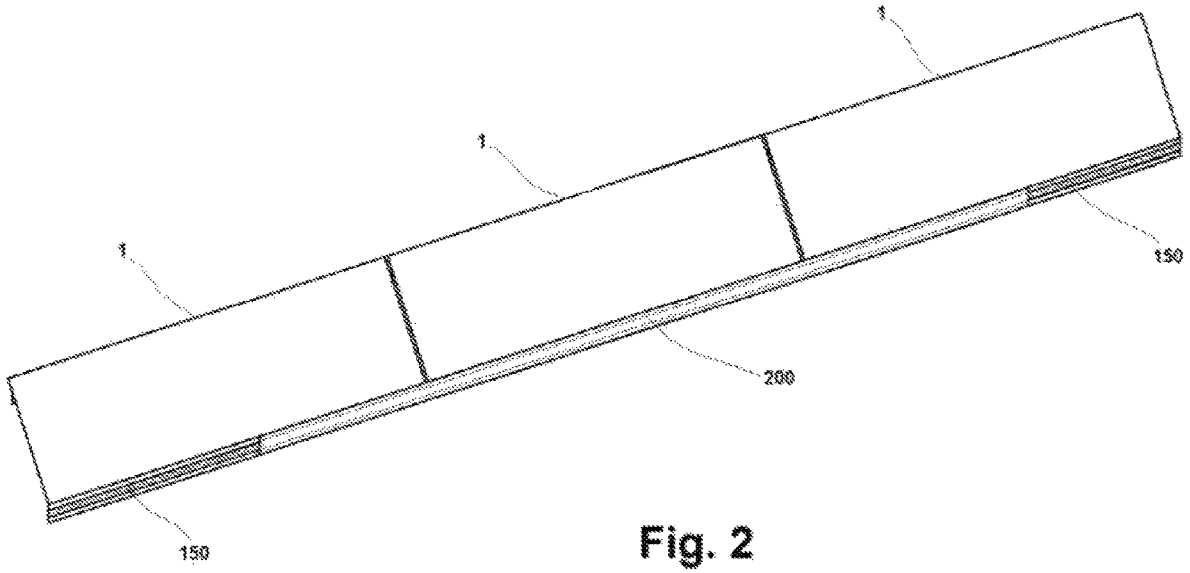
FIG. 2 is a top perspective view of the embodiment of the present invention shown in FIG. 1A, depicting multiple product support members joined together by a single elongated price tag support member.

The price tag support member 200 need not have a length equal to the width of the product support member 100. In one embodiment the price tag support member 200 may be significantly longer than the width of the product support member 100. See FIG. 2. A longer price tag support member 200 can be placed onto the attachment flanges 150 of more than one product support member 100 at a time, thereby providing a means for securing multiple shelf covers 1 to each other. See FIG. 2. In the same manner, a price tag support member 200 may be shorter than the width of the product support member 100, to fill in the end gap of a line of shelves (see, e.g., the relatively short portions of shelf covers 1 left exposed in FIG. 2).

The attachment flange 150 of the product support member 100 and the channel 210 of the price tag support member 200 must be configured symmetrically in order to allow the price tag support member 200 to be attached to the product support member 100. In one embodiment, the attachment flange 150 of the product support member 100 is convex. It has an outer surface 152 curved along an arc of a circle of more than one hundred eighty degrees. See FIG. 7. The corresponding channel 210 of the price tag support member 200 is concave, having an inner surface 212 curved along an arc of the circle of more than one hundred eighty degrees. The arc of the inner surface 212 of the channel 210 is less than the arc of the outer surface 152 of the attachment flange 150. The attachment flange 150 and the channel 210 are dimensioned with tight tolerances so that the attachment flange 150 fits snugly within the channel 210, retaining the price tag support member 200 in a fixed relative orientation to the product support member 100. So configured, the price tag support member 200 is able to pivot about the attachment flange. See FIGS. 6A, 6B, and 6C.

In another embodiment, the attachment flange 150 of the product support member 100 is convex, with a triangular cross section. It has an upper surface 154, a front surface 156, and a lower surface 158, with the upper surface 154 oriented at an acute angle to the front surface 156 and the lower surface 158 oriented at an acute angle to the front surface 156. See FIG. 8. The corresponding channel 210 of the price tag support member 200 is concave with a triangular cross section. It has an inner surface 212 having an upper surface 214, a front surface 216, and a lower surface 218, with the upper surface 214 oriented at an acute angle to the front surface 216 and the lower surface 218 oriented at an acute angle to the front surface 216. The acute angles of the channel 210 correspond to the acute angles of the attachment flange. This configuration allows the price tag support member 200 to be held in a single fixed orientation relative to the product support member 100. Other geometric configurations of the attachment flange 150 and channel 210 are also contemplated (such as partial hexagons and partial octagons), allowing for limited multiple relative orientations between the price tag support member 200 and the product support member 100.

The price tag support member 200 may be configured in any number of ways. In one embodiment, it is comprised of an elongate body 230 having a back face 240, an upper front face 252, a lower front face 254, a top side 260, a bottom side 270, an upper lip 282, and a lower lip 284. See FIGS. 6A and 6B. The back face 240 of the body 230 of the price tag support member 200 is oriented substantially vertically, the upper front face 252 of the body 230 of the price tag support member 200 is oriented at an angle and spaced apart from the back face 240 of the body 230, the lower front face 254 of the body 230 of the price tag support member 200 is oriented substantially vertically, is adjacent to the lower portion of the upper front face 252 of the body 230, and is spaced apart from the back face 240 of the body 230, the top side 260 of the body 230 of the price tag support member 200 is oriented substantially horizontally and joins the top portion of the upper front face 252 of the body 230 to the back face 240 of the body 230, and the bottom side 270 of the body 230 of the price tag support member 200 is oriented substantially horizontally and joins the lower front face 254 of the body 230 to the back face 240 of the body 230. This configuration results in the body 230 of the price tag support member 200 being hollow; as such, it may be manufactured by an extrusion process.

In this embodiment, the upper lip 282 of the price tag support member 200 is formed into the top portion of the upper front face 252 of the body 230 of the price tag support member 200. It extends forward and downward from the upper front face 252 of the body 230. The lower lip 284 is formed into the lower portion of the upper front face 252 of the body 230 of the price tag support member 200. It extends forward and upward from the upper front face 252 of the body 230. See FIG. 6B. A channel 290 is formed upon the upper front face 252 of the body 230 between the upper lip 282 and the lower lip 284. An elongate, planar price tag 60 can be inserted into the channel 290 and held in place by the upper lip 282 and lower lip 284. See FIG. 7.

Figure 9A:
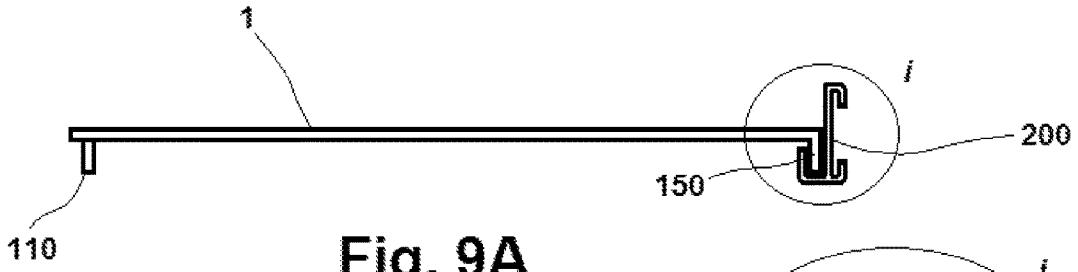
FIG. 9A is a side plan view of an alternative embodiment of the present invention shown depicting the price tag support member attached to the front edge of the product support member.
Figure 9B:
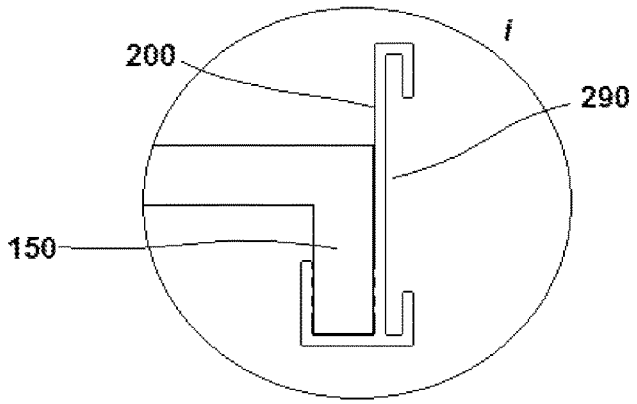
FIG. 9B is an enlarged side plan view of area i of the embodiment of the present invention shown in FIG. 9A.

In the preferred embodiment of the present invention, the attachment flange 150 of the product support member 100 is angled substantially ninety degrees from the product support member 100 in a downward direction. See FIGS. 9A and 10A. The attachment flange 150 has a uniform thickness. Preferably, the attachment flange 150 is rectangular in shape. The price tag support member 200 in this embodiment is configured as an elongate body oriented substantially vertically. The elongate body has a back surface, a front surface, a top portion, a bottom portion, an upper lip 282, and a lower lip 284. The back surface of the body of the price tag support member 200 is oriented towards the attachment flange 150 of the product support member 100, the channel 210 of the price tag support member 200 is located along the back surface of the body of the price tag support member 200 proximate to the bottom portion of the body, the upper lip 282 is located along the front surface of the body proximate to the top portion of the body and extends forward and downward from the top portion of the body, and the lower lip 284 is located along the front surface of the body proximate to the bottom portion of the body and extends forward and upward from the bottom portion of the body. See FIG. 10B. A channel 290 is formed upon the front surface of the body, into which an elongate, planar price tag 60 can be inserted and held in place by the upper lip 282 and lower lip 284. The channel 210 of the price tag support member 200 is concave with a "U" cross section. See FIG.

10B. The lower portion of the attachment flange 150 is configured to snugly fit into the channel 210 of the price tag support member 200, such that it is retained in place by frictional forces. In the most preferred embodiment, located within the concavity of the channel 210 of the price tag support member 200 is a plurality of gripping flanges 220. Each gripping flange 220 extends inward from the inner surface of the channel 210 into the concavity of the channel 210, and is further oriented downward towards the bottom of the channel 210. See FIG. 10B. This configuration improves the retention of the attachment flange 150 within the channel 210.

What has been described and illustrated herein are preferred embodiments of the shelf cover of the present invention along with some it its variations. The terms, descriptions and figures used herein are set forth by way of illustration only and are not meant as limitations. Those skilled in the art will recognize that many variations are possible within the spirit and scope of the invention in which all terms are meant in their broadest, reasonable sense unless otherwise indicated. Other embodiments not specifically set forth herein are also contemplated.

I claim:

1. A shelf cover to be used with a shelving unit, said shelving unit having at least one shelf having a depth and oriented substantially horizontally and having a backing element oriented substantially vertically, with the shelf of the shelving unit attached to the backing element of the shelving unit such that there is a gap between a rear edge of the shelf and the backing element, said shelf cover comprising a product support member, said product support member being substantially planar and rigid and having a width, a thickness, and a depth just slightly greater than the depth of the shelf of the shelving unit;

a rear retention flange, said rear retention flange adjacent to a back edge of the product support member and angled substantially ninety degrees from the product support member in a downward direction, said rear retention flange having a uniform thickness slightly less than a width of the gap between the rear edge of the shelf and the backing element, and a width slightly less than the width of the product support member; and a price tag support member, said price tag support member located along a front edge of the product support member and capable of supporting a price tag thereon;

wherein the shelf cover is adapted to be placed onto the shelf of the shelving unit and the product support member of the shelf cover is adapted to rest on a top surface of the shelf of the shelving unit and the rear retention flange of the shelf cover is adapted to be inserted into the gap between the rear edge of the shelf and the backing element of the shelving unit, the price tag support member of the shelf cover is adapted to extend beyond a front edge of the shelf of the shelving unit, the price tag support member is removably attached to the front edge of the product support member, the product support member comprises an attachment flange located along the front edge of the product support member, the price tag support member comprises a channel which accommodates the attachment flange of the product support member, the price tag support member is attached to the product support member by inserting the attachment flange of the product support member into the channel of the price tag support member, the attachment flange of the product support member is convex with an outer surface curved along a first arc of a circle, said first arc being greater than one hundred eighty degrees, and the channel of the price tag support member is concave with an inner surface curved along a second arc of the circle, said second arc being greater than one hundred eighty degrees and less than the first arc, such that the attachment flange of the product support member fits snugly within the channel of the price tag support member in a fixed relative orientation thereto;

wherein the price tag support member is pivoted relative to the product support member by repositioning the price tag support member relative to the attachment flange of the product support member so that the price tag support member is oriented at a desired angle relative to the product support member.

2. A shelf cover to be used with a shelving unit, said shelving unit having at least one shelf having a depth and oriented substantially horizontally and having a backing element oriented substantially vertically, with the shelf of the shelving unit attached to the backing element of the shelving unit such that there is a gap between a rear edge of the shelf and the backing element, said shelf cover comprising a product support member, said product support member being substantially planar and rigid and having a width, a thickness, and a depth just slightly greater than the depth of the shelf of the shelving unit;

a rear retention flange, said rear retention flange adjacent to a back edge of the product support member and angled substantially ninety degrees from the product support member in a downward direction, said rear retention flange having a uniform thickness slightly less than a width of the gap between the rear edge of the shelf and the backing element, and a width slightly less than the width of the product support member; and a price tag support member, said price tag support member located along a front edge of the product support member and capable of supporting a price tag thereon;

wherein the shelf cover is adapted to be placed onto the shelf of the shelving unit and the product support member of the shelf cover is adapted to rest on a top surface of the shelf of the shelving unit and the rear retention flange of the shelf cover is adapted to be inserted into the gap between the rear edge of the shelf and the backing element of the shelving unit, the price tag support member of the shelf cover is adapted to extend beyond a front edge of the shelf of the shelving unit, the price tag support member is removably attached to the front edge of the product support member, the price tag support member comprises an elongate body, having a back face, an upper front face, a lower front face, a top side, a bottom side, an upper lip, and a lower lip;

wherein the back face of the body of the price tag support member is oriented substantially vertically, the upper front face of the body of the price tag support member is oriented at an angle to the vertical, with a top portion of the upper front face of the body located closer to the back face of the body than a lower portion of the upper front face of the body, with the upper front face of the body being spaced apart from the back face of the body, the lower front face of the body of the price tag support member is oriented substantially vertically, is adjacent to the lower portion of the upper front face of the body, and is spaced apart from the back face of the body, the top side of the body of the price tag support member is oriented substantially horizontally and joins the top portion of the upper front face of the body to the back face of the body, the bottom side of the body of the price tag support member is oriented substantially horizontally and joins the lower front face of the body to the back face of the body, the upper lip is formed into a top portion of the upper front face of the body of the price tag support member, extending forward and downward from the upper front face of the body, and the lower lip is formed into the lower portion of the upper front face of the body of the price tag support member, extending forward and upward from the upper front face of the body, such that a channel is formed upon the upper front face of the body whereby an elongate, planar price tag can be inserted into the channel and held in place by the upper lip and lower lip, and the back face of the body of the price tag support member is removably attached to the front edge of the product support member.

3. The shelf cover of claim 2 wherein the product support member comprises an attachment flange located along the front edge of the product support member, and the price tag support member comprises a channel formed into the back face of the body of the price tag support member which accommodates the attachment flange of the product support member;

wherein the price tag support member is attached to the product support member by inserting the attachment flange of the product support member into the channel of the price tag support member.

4. The shelf cover of claim 3 wherein the attachment flange of the product support member is convex with an outer surface curved along a first arc of a circle, said first arc being greater than one hundred eighty degrees, and the channel of the price tag support member is concave with an inner surface curved along a second arc of the circle, said second arc being greater than one hundred eighty degrees and less than the first arc, such that the attachment flange of the product support member fits snugly within the channel of the price tag support member in a fixed relative orientation thereto;

wherein the price tag support member is pivoted relative to the product support member by repositioning the price tag support member relative to the attachment flange of the product support member so that the price tag support member is oriented at a desired angle relative to the product support member.

5. The shelf cover of claim 3 wherein the attachment flange of the product support member is convex, having an upper surface, a front surface, and a lower surface, with the upper surface of the attachment flange oriented at a first acute angle to the front surface of the attachment flange and the lower surface of the attachment flange oriented at a second acute angle to the front surface of the attachment flange, and the channel of the price tag support member is concave with an inner surface having an upper surface, a front surface, and a lower surface, with the upper surface of the channel oriented at the first acute angle to the front surface of the channel and the lower surface of the channel oriented at the second acute angle to the front surface of the channel.

6. A shelf cover to be used with a shelving unit, said shelving unit having at least one shelf having a depth and oriented substantially horizontally and having a backing element oriented substantially vertically, with the shelf of the shelving unit attached to the backing element of the shelving unit such that there is a gap between a rear edge of the shelf and the backing element, said shelf cover comprising a product support member, said product support member being substantially planar and rigid and having a width, a thickness, and a depth just slightly greater than the depth of the shelf of the shelving unit;

a rear retention flange, said rear retention flange adjacent to a back edge of the product support member and angled substantially ninety degrees from the product support member in a downward direction, said rear retention flange having a uniform thickness slightly less than a width of the gap between the rear edge of the shelf and the backing element, and a width slightly less than the width of the product support member; and a price tag support member, said price tag support member located along a front edge of the product support member and capable of supporting a price tag thereon;

wherein the shelf cover is adapted to be placed onto the shelf of the shelving unit and the product support member of the shelf cover is adapted to rest on a top surface of the shelf of the shelving unit and the rear retention flange of the shelf cover is adapted to be inserted into the gap between the rear edge of the shelf and the backing element of the shelving unit, the price tag support member of the shelf cover is adapted to extend beyond a front edge of the shelf of the shelving unit, the price tag support member is removably attached to the front edge of the product support member, the product support member comprises an attachment flange located along the front edge of the product support member, the price tag support member comprises a channel which accommodates the attachment flange of the product support member, the price tag support member is attached to the product support member by inserting the attachment flange of the product support member into the channel of the price tag support member, the attachment flange of the product support member is located adjacent to the front edge of the product support member and angled substantially ninety degrees from the product support member in a downward direction, said attachment flange having a uniform thickness and a width substantially the same as the width of the product support member, the channel of the price tag support member is concave with an upper opening and a closed lower surface thereby forming a U-shaped cross-section, such that the attachment flange of the product support member fits snugly within the channel of the price tag support member in a fixed relative orientation thereto, and the channel of the price tag support member comprises a plurality of gripping flanges, each such gripping flange extending inward from an inner surface of the channel into a cavity of the channel and being oriented downward towards a bottom of the channel.

7. A shelf cover to be used with a shelving unit, said shelving unit having at least one shelf having a depth and oriented substantially horizontally and having a backing element oriented substantially vertically, with the shelf of the shelving unit attached to the backing element of the shelving unit such that there is a gap between a rear edge of the shelf and the backing element, said shelf cover comprising a product support member, said product support member being substantially planar and rigid and having a width, a thickness, and a depth just slightly greater than the depth of the shelf of the shelving unit;

a rear retention flange, said rear retention flange adjacent to a back edge of the product support member and angled substantially ninety degrees from the product support member in a downward direction, said rear retention flange having a uniform thickness slightly less than a width of the gap between the rear edge of the shelf and the backing element, and a width slightly less than the width of the product support member; and a price tag support member, said price tag support member located along a front edge of the product support member and capable of supporting a price tag thereon;

wherein the shelf cover is adapted to be placed onto the shelf of the shelving unit and the product support member of the shelf cover is adapted to rest on a top surface of the shelf of the shelving unit and the rear retention flange of the shelf cover is adapted to be inserted into the gap between the rear edge of the shelf and the backing element of the shelving unit, the price tag support member of the shelf cover is adapted to extend beyond a front edge of the shelf of the shelving unit, the price tag support member is removably attached to the front edge of the product support member, the price tag support member comprises an elongate body, having a back surface, a front surface, a top portion, a bottom portion, an upper lip, and a lower lip, wherein the back surface of the body of the price tag support member is oriented towards the attachment flange of the product support member, the channel of the price tag support member is located along the back surface of the body of the price tag support member proximate to the bottom portion of the body of the price tag support member, the upper lip is located along the front surface of the body of the price tag support member proximate to the top portion of the body of the price tag support member and extending forward and downward from the top portion of the body, and the lower lip is located along the front surface of the body of the price tag support member proximate to the bottom portion of the body of the price tag support member and extending forward and upward from the bottom portion of the body, such that a channel is formed upon the front surface of the body whereby an elongate, planar price tag can be inserted into said channel and held in place by the upper lip and lower lip, and the back surface of the body of the price tag support member is removably attached to the front edge of the product support member, the product support member comprises an attachment flange located along the front edge of the product support member, the price tag support member comprises a channel formed into the back face of the body of the price tag support member which accommodates the attachment flange of the product support member, the price tag support member is attached to the product support member by inserting the attachment flange of the product support member into the channel of the price tag support member, the attachment flange of the product support member is located adjacent to the front edge of the product support member and angled substantially ninety degrees from the product support member in a downward direction, said attachment flange having a uniform thickness and a width substantially the same as the width of the product support member, the channel of the price tag support member is concave with an upper opening and a closed lower surface thereby forming a U-shaped cross-section, such that the attachment flange of the product support member fits snugly within the channel of the price tag support member in a fixed relative orientation thereto, and the channel of the price tag support member comprises a plurality of gripping flanges, each such gripping flange extending inward from an inner surface of the channel into a cavity of the channel and being oriented downward towards a bottom of the channel.

* * * * *